175-40 SR
5/7/85 OR 4,515,225

United States Patent [19]

Dailey

[11] Patent Number: 4,515,225

[45] Date of Patent: May 7, 1985

[54] MUD ENERGIZED ELECTRICAL GENERATING METHOD AND MEANS

[75] Inventor: Patrick E. Dailey, Torrance, Calif.

[73] Assignee: Smith International, Inc., Newport Beach, Calif.

[21] Appl. No.: 343,871

[22] Filed: Jan. 29, 1982

[51] Int. Cl.[3] ..... E21B 47/00

[52] U.S. Cl. ..... 175/40; 175/93

[58] Field of Search ..... 175/40, 45, 50, 93, 175/107

[56] References Cited

U.S. PATENT DOCUMENTS

| | | | |
|---|---|---|---|
| 3,036,645 | 5/1962 | Rowley | 175/104 |
| 3,437,992 | 4/1969 | Johnston . | |
| 3,983,948 | 10/1976 | Jeter | 175/45 |
| 4,098,359 | 7/1978 | Birdwell | 175/93 |
| 4,211,291 | 7/1980 | Kellner | 175/93 |
| 4,215,426 | 7/1980 | Klatt | 175/40 |
| 4,298,077 | 11/1981 | Emery | 175/107 |

*Primary Examiner*—William F. Pate, III

*Attorney, Agent, or Firm*—Christie, Parker & Hale

[57] ABSTRACT

A drilling instrument adapted to be positioned in a conduit for the flow of mud. The instrument has a passage sealing a fluid from the mud. Means is responsive to energy derived from the mud for causing the sealed fluid to flow. An electrical generator derives energy from the flowing fluid to provide electrical energy.

4 Claims, 5 Drawing Figures

REG.
REG.
DOWNSTREAM RESERVOIR -68
PUMP -47
ACCUMULATOR -92
PULSER -15
UPSTREAM RESERVOIR -80
ELECTRONIC INSTRUMENT -104
FLOW

MUD ENERGIZED ELECTRICAL GENERATING METHOD AND MEANS

BACKGROUND OF THE INVENTION

1. Field of the Invention

This invention relates to electrical energy generation and more specifically to mud activated electrical power generation for a drilling instrument.

2. Description of the Prior Art

Mud energized electrical power generating systems are known in the drilling art. Drill bit direction information, such as azimuth and inclination, are provided by downhole sensors that are located in the vicinity of the drill bit. Several telemetry techniques are presently in use for transmitting this directional information uphole.

The downhole sensors usually require electrical power for their operation and such power typically has been provided by either batteries or mud-driven turbines. Batteries generally have a relatively short life span since known devices are unable to provide sustained power delivery at the high operating temperatures that characterize conventional drilling operations. Thus the batteries require frequent replacement providing corresponding frequent and costly interruptions in drilling operations.

A mud energized system typically includes a turbine coupled to an electrical generator for providing power to the downhole sensor. The turbine, however, is driven by and thus is in contact with the drilling mud. The drilling mud normally contains cuttings, debris and other abrasives which cause rapid deterioration of the turbine blades that come in contact with the mud. In addition, large solid materials carried by the mud frequently impact and thus damage the turbine blades.

Attempts have been made to place filters in the mud path to filter out some of the material from the mud. However such filters are prone to being clogged thus requiring either maintenance or replacement.

The electrical or hydraulic power generator associated with such mud-driven turbines normally must operate in a protected or "clean" and pressure compensated environment. As a result the power generator is generally placed in a compartment isolated from the drilling mud by a rotary type seal. However, due to the debris ladened, abrasive and corrosive nature of the drilling mud, these rotary type seals are prone to rapid deterioration and even frequent failure.

SUMMARY OF THE INVENTION

The deficiencies and limitations of the prior art are remedied by the present invention. Briefly, one embodiment of the present invention comprises a drilling instrument adapted to be positioned in a conduit for the flow of mud. The instrument has a passage sealing a fluid from the mud. Means is responsive to energy derived from the mud for causing the sealed fluid to flow. An electrical generator derives energy from the flowing fluid to provide electrical energy.

An embodiment of the present invention is also a drilling instrument for use in the passage of a conduit through which mud is forced to flow. The instrument comprises at least one passage for containing a fluid separate from the mud in the conduit passage. Means, which is responsive to differences in pressure in the flowing mud, moves the separate fluid in the at least one passage. An electrical generator is provided. Means is responsive to the movement of the separate fluid in the at least one passage to provide a mechanical movement to the electrical generator. The electrical generator is responsive to the movement for generating electrical energy.

With such an arrangement, the means for moving the electrical generator can be maintained separate from debris ladened mud. Additionally, there is no need for providing seals or other means for isolating the debris ladened mud from the electrical generator.

Preferably the means for moving comprises at least one hydraulic pump. Also preferably the means for providing mechanical movement comprises a turbine positioned in the at least one passage for rotation responsive to the movement of the fluid.

Additionally there is preferably provided an accumulator for the separate fluid for maintaining substantially constant flow of fluid to the means for providing mechanical movement.

Preferably a shutoff valve is provided for preventing the flow of separate fluid past the means for moving, during periods in which the above mentioned accumulator is uncharged but in which a pressure differential may exist.

Also preferably the means for providing mechanical movement is positioned in the at least one passage and the instrument comprises a pressure regulator positioned in the at least one passage so as to regulate the pressure differential of the separate fluid across the means for providing mechanical movement.

According to a preferred arrangement the instrument also comprises means responsive to the separate fluid in the at least one passage for varying the pressure of the mud flowing in the passage in the conduit.

Preferably the at least one passage comprises reservoirs for the separate fluid. At least one of the reservoirs is adapted for location upstream, and at least one of the reservoirs is adapted for location downstream in the flow of mud in the conduit. The upstream and downstream reservoirs each are adapted for transmitting the pressure in the mud, adjacent to the respective reservoir, to the separate fluid. The upstream and downstream reservoirs are in fluid communication through the at least one passage.

According to a preferred arrangement the instrument also comprises means for forming pressure pulses in the flowing mud. The means for forming pressure pulses comprises an actuation chamber in the at least one passage having a piston therein dividing the actuation chamber into first and second chamber portions. The at least one passage has a first passage portion providing fluid communication between the upstream reservoir and the first chamber portion for actuating the piston in the direction of the second chamber portion, thereby causing a pressure pulse in the flowing mud. The at least one passage has a second passage portion providing fluid communication between the second chamber portion and the downstream reservoir for allowing transfer of the separate fluid to the downstream reservoir as the piston is actuated.

Also disclosed is a method for generating electrical energy from mud flowing in a conduit. The steps include use of energy formed by the flowing mud to create a flow in a fluid which is separate from the flowing mud, and driving an electrical generator with the flowing separate fluid.

Preferably a pressure pulse is created in the flowing mud and energy created by the pressure pulse in the flowing mud is used to force the flow of the separate fluid.

DETAILED DESCRIPTION

Figure 1:
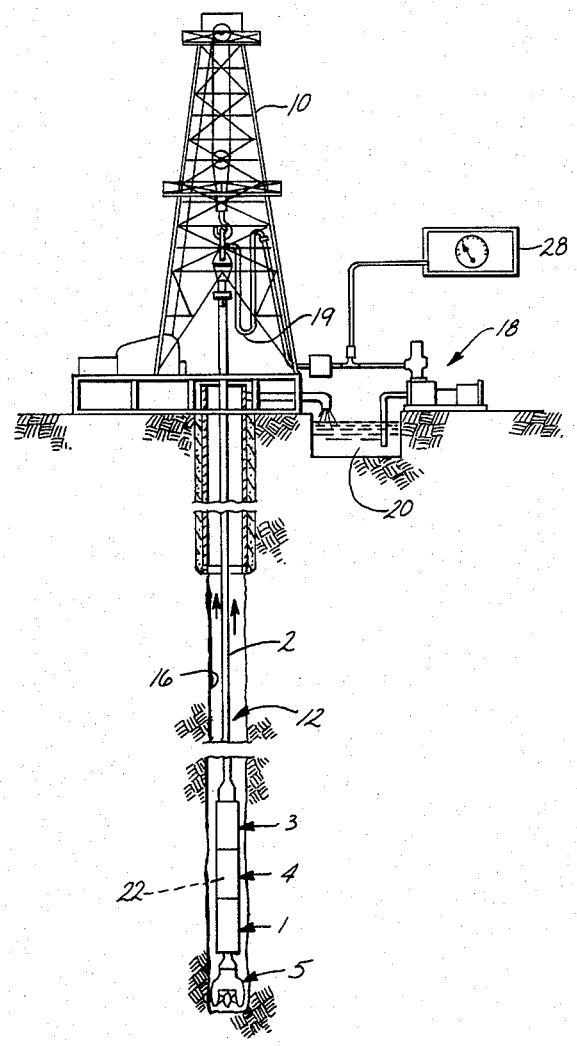
FIG. 1 is a schematic and cross-sectional view of an oil well drilling and telemetry system having a drilling instrument with electrical generating means and embodying the present invention.

FIG. 1 depicts an oil well drilling system configured for a stationary string, downhole mud motor or turbine drill, drilling operation and embodies the present invention. A mud pulse telemetry system, to be explained, is used as part of a wireless steering tool for orienting a mud motor 1 and monitoring its drilling progress in terms of magnetic direction and borehole inclination angle. The present invention involves means for generating electrical energy for operation of the telemetry system and downhole instrumentation.

A drilling derrick 10 is connected to and supplies tension and reaction torque for a drilling string 12 which includes the mud motor 1, drill pipe 2, standard drill collars 3, a non-magnetic drill collar section (hereinafter collar) 4, and a conventional drill bit 5. A conventional mud pump apparatus 18 pumps mud out of a mud pit 20, passing the mud through conduit 19 to the interior of the drill string 12 and hence collar 4. The interior of the drill string 12 has a generally tubular passage, allowing the mud to flow down through the drill string, exiting near the drill bit 5 and recirculating back upward along the annulus, between the drill string and the wall of the borehole 16 where the mud returns to the mud pit 20.

The drilling system of FIG. 1 includes a steering tool 22 which, as depicted by dashed lead lines, is located in the interior of the collar 4. The steering tool 22, shown in detail in FIG. 2, includes a mud pulser 26 which generates signals in the mud flowing down through the drill string 12. In addition the steering tool 22 includes an electronic instrument 104 for generating electrical control signals for the mud pulser 26 to control its sequence of operation. A transducer and indicator 28 senses and indicates the pulses in the mud received at the top of the borehole 16.

Although FIG. 1 discloses the steering tool 22 in a stationary string drilling operation, it may also be employed in conventional rotary drilling operations. Typical applications for such a system include formation logging, directional surveying, critical downhole drilling parameters, and impending blowout detection.

Figures 2, 4:
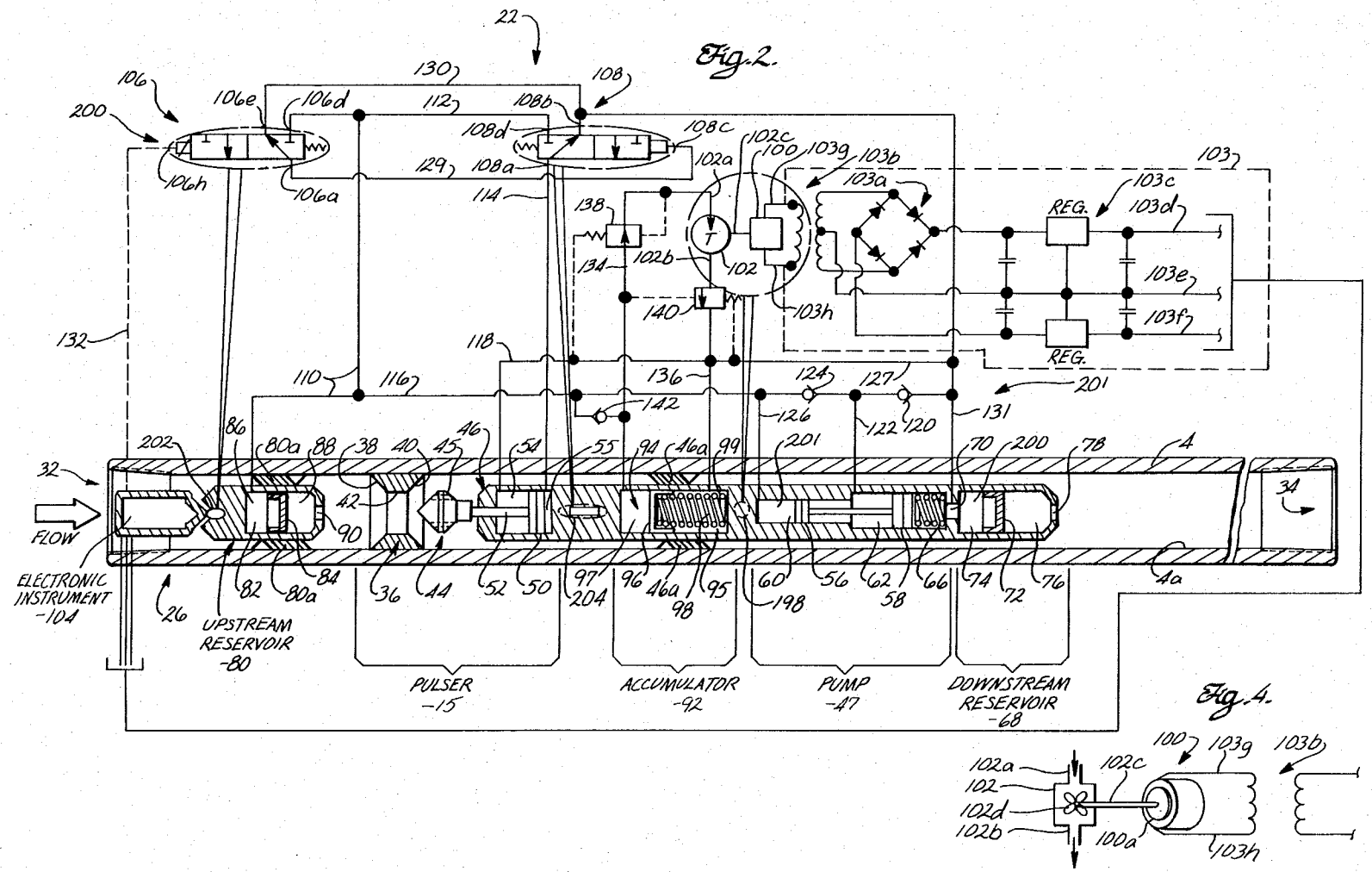
FIG. 2 is a schematic and partially cross-sectional view of the drilling instrument having the electrical generating means of FIG. 1.
FIG. 4 is an enlarged schematic view, partially in cross-section, of the turbine 102, the generator 100 and the transformer 103*b.

Turning now to FIG. 2, the drill collar 4 is generally tubular in shape forming an interior passage 4*a* for the flowing mud and contains a pulser 15. The passage in collar 4 has an upstream mud entry port 32 and a downstream mud port 34. As previously described, drilling mud is forced to flow through the passage in collar 4 under the action of the mud pump 18.

An annular ring 36 is disposed coaxially about and is affixed to the wall of passage 4*a* of the collar 4. The ring 36 has inclined, generally oppositely facing side walls 38 and 40 and a connecting wall 42. The ring 36 serves to reduce the cross-sectional area of the passage through which the mud is forced to flow. The annular ring 36 thus provides a constriction in the mud flow path.

A pulser poppet 44 is extendable from an actuator housing 46 and is adapted for cooperating with annular ring 36 to restrict the flow of the mud through the collar 4. The housing 46 is generally cylindrical shaped and is connected to the inside of collar 4 by longitudinally narrow keys 46*a* which are spaced apart to permit mud flow between them. The poppet has a conical shape with an inclined exterior front wall surface corresponding to the incline of ring wall 40. The poppet 44 travels between extended and retracted positions, and in the extended position the poppet exterior front wall nears or contacts the ring wall 40. Poppet 44 is shown in the retracted position in FIG. 2.

The poppet 44 is coupled to a piston 50 by means of shaft 52. The piston 50 travels between extended and retracted positions in a piston chamber which has chamber portions 54 and 55. The piston chamber is located at the upstream portion of the pump housing 46. The shaft 52 and poppet 44 travel in a path that is coaxial with annular ring 36.

Preferably a pair of passageways 45, depicted in dashed lines, extend through the poppet 44. The passageways 45 provide a bypass path to permit the drilling mud to flow through the collar 4 when the poppet 44 engages the annular ring 36. The passageways thus provide for a continuous yet restricted flow path for mud through the drill string when the uphole pumping apparatus utilizes positive displacement type pumps.

A pump 47 is located centrally in the pump housing 46 and includes a pair of interconnected cylindrical shaped pistons 56 and 58 that travel in cylindrical shaped piston chambers 60 and 62, respectively. The piston chambers 60 and 62 are coaxial. To be later explained, the diameter and hence cross-sectional area of piston chamber 60 is less than the diameter and cross-sectional area of piston chamber 62. A coil spring 66 is located between the right or downstream side of piston 58 and the downstream extremity of piston chamber 62.

A cylindrical shaped downstream reservoir 68 is located in the downstream portion of the pump housing 46. The downstream reservoir 68 is in fluid communiction with the pump 47 at the downstream portion of piston chamber 62 by means of an interconnecting passageway 70.

The downstream reservoir 68 includes a free floating piston 72. The piston 72 travels longitudinally within the reservoir 68. The free floating piston 72 divides the downstream reservoir 68 into upstream and downstream portions 74 and 76, respectively. A passageway 78 provides fluid communication between the chamber portion 76 and the drilling mud flowing in the vicinity of the downstream port 34. By virtue of the free floating action of piston 72, the fluid pressure in the chamber portions 74 and 76 is essentially equal to the pressure of the drilling mud flowing in the vicinity of the downstream port 34.

To be discussed, the portion 74 of reservoir 68 contains a medium such as hydraulic fluid (hereinafter "clean" fluid) designated by numeral 200 that acts as a working fluid in an electrical energy generating subsystem, whereas the portion 76, due to passageway 78, is exposed to and contains drilling mud.

An upstream reservoir 80 is located in the collar 4 between the upstream port 32 and the annular ring 36. The upstream reservoir 80 includes a cylindrical shaped upstream reservoir chamber 82 and a free floating cylindrical shaped piston 84 that is capable of movement longitudinally in the upstream reservoir chamber 82. The free floating piston 84 divides the upstream reservoir chamber 82 into an upstream portion 86 and a downstream portion 88. A passageway 90 extends between the portion 88 and a portion of the collar 4 that is in fluid communication with the drilling mud flowing in the vicinity of the upstream port 32. The portion 86 contains the clean fluid, whereas the portion 88, due to passageway 90, contains drilling mud. By virtue of the free floating piston 84 the fluid pressure in the portions 86 and 88 essentially equals the pressure of the drilling mud in the upstream region of the upstream reservoir 80. Keys 80*a* connect the reservoir 80 to the inside of collar 4 and are longitudinally narrow and spaced apart so as to allow mud to flow by them as the mud flows between ports 32 and 34.

An accumulator 92 is also located in the central portion of the pump housing 46. The accumulator 92 comprises a cylindrical shaped accumulator chamber 94, a spring biased piston 96, and a piston driven coil spring 98. The coil spring 98 is mounted between the downstream extremity 99 of the accumulator chamber 94 and piston 96. Piston 96 divides accumulator chamber 94 into downstream portion 95 and upstream portion 97. It should be noted at this point that although not shown in the drawings, piston 96 as well as each of pistons 50, 56, 58, 72 and 84 are cylindrical shaped and include peripheral seals to prevent fluids, in one portion of the corresponding chamber, from flowing around the piston and into the other portion of the chamber.

An electrical energy generating subsystem preferably includes an electrical alternator 100, a turbine 102 and an alternating current (A.C.) to direct current (D.C.) rectifier 103. The electrical alternator 100 and the A.C. to D.C. rectifier 103 may, in the alternative, be a direct current electrical generator. The electrical system 103 includes a full wave rectifier diode bridge 103*a* having an input coupled to the output of alternator 100 through transformer 103*b*. The output of full wave rectifier bridge 103*a* is connected to the input of bipolar D.C. regulator circuit 103*c* which filters and regulates signals from rectifier circuit 103*a* and provides, by way of example, +12, 0 and −12 volts (V) direct current power, respectively, at output conductors 103*d*, 103*e* and 103*f*.

Although shown schematically outside of collar 4, the A.C. to D.C. rectifier 103 is preferably located in sealed electronic instrument package 104 and is connected to A.C. alternator 100 by means of insulated conductors 103*g* and 103*h*.

As indicated in FIG. 4, turbine blades 102*d* are positioned in the flow of fluid between input and output ports 102*a* and 102*b* and rotate shaft 102*c* which in turn rotates armature 100*a* of electrical alternator 100. Rotation of armature 100*a* creates an electrical alternating current (A.C.) signal in the primary windings of transformer 103*b*.

Although turbine 102 and alternator 100 are depicted schematically external to collar 4, they are preferably mounted inside the actuator housing 46 in a region 198. It will be understood by those skilled in the art that the turbine, alternator and rectifier system, being located in region 198, are in an environment which is pressure compensated by the downstream reservoir and filled with the clean hydraulic fluid. All turbine generator components are thus isolated from the flowing mud. Since the turbine 102*d* is rotated by the clean fluid passing between ports 102*a* and 102*b*, there is no need for special protective seals to isolate bearings from the debris ladened mud flowing through the passage of collar 4.

The clean fluid 200 flows around in closed passages, generally depicted by the numeral 201. Closed passages 201 comprise pump 47, piston chamber 54, reservoir 68, reservoir 80, accumulator 92, and turbine 102. The turbine 102 is the prime mover for the electrical alternator 100 and is rotated or actuated by the clean fluid 200 as it is forced to flow through passages 201 because of energy derived from the flowing mud. The closed passages 201 also include an electrically controlled pilot valve 106, hydraulically controlled poppet control valve 108 for controlling the flow of the working fluid within the closed passages, shutoff valves 138 and 140 and, to be described, interconnecting conduits.

The pilot valve 106 is coupled to the upstream reservoir 82 by conduit 110. The poppet control valve 108 is coupled to the piston chamber portion 55 by means of conduit 114. Passageway 70 in the pump 47 is coupled to the conduit 110 by means of conduits 116, 131, check valves 120 and 124, and conduit 131. Piston chamber portion 54 is coupled to passageway 70 by means of conduits 118, 127 and 131. Passageway 70 is coupled to piston chamber 62 by means of conduit 122, check valve 120 and conduit 131. Piston chamber 62 is coupled to piston chamber 60 by means of conduit 126, check valve 124 and conduit 122. Check valves 120 and 124 each conduct fluid flow only in one direction and only when the fluid pressure from right to left in FIG. 2 across the valve exceeds a "cracking" pressure. Preferably the "cracking" pressure is about 1 psi. Each valve conducts fluid in a right to left direction as viewed in FIG. 2. Passageway 70 is coupled to port 108*b* of control valve 108 by means of conduits 131 and 128.

Port 106*a* of pilot valve 106 is coupled to the control port 106*c* of control valve 108 by means of conduit 129. Port 106*e* of the pilot valve 106 is coupled to passageway 70 by means of conduits 130, 128 and 131.

The electronic instrument package 104 is coupled to the electrical control input 106*h* of pilot valve 106 by means of electrical conductor 132 shown in dashed line.

The turbine 102 is coupled between chamber portions 97 and 95 of the accumulator 92 by means of conduit 134, pressure regulator 138, shutoff valve 140, and conduit 136. To be described, the pressure regulator 140 maintains the fluid across the turbine 102 at substantially a constant predetermined pressure. A check valve 142 is coupled between conduits 116 and 134.

The pilot valve 106 is a three-way, two-position solenoid operated spring offset directional control valve and which is normally closed and which is similar to the ITT General Controls valve No. AV11A. The valve is suitable for systems such as described herein that are subject to high acceleration forces, high flow, minimum pressure drop, tight shutoff and high temperatures.

The control valve 108 may be a three-way, two-position pilot pressure operated spring offset directional control valve which is normally closed and which is similar to Versa Products Company valve No. BPS- 3208. Valve actuation is controlled by a pilot pressure signal usually from another valve (pilot valve 106) which may be remotely located. The pilot signal pressurizes a small cylinder integrated into the valve as an actuator for the valve. When the pilot is pressurized, the valve is actuated and when the pressure is removed from the pilot, the valve is returned to the unactuated position. As shown in FIG. 2, the valves 106 and 108 are shown in schematic and in the normally closed condition. Conduit 129 is coupled to port 108*c* of valve 108 and in the opened condition conduit 129 is coupled to pilot valve port 106*a*.

The turbine 102 is relatively small having a turbine blade which is turned by the clean fluid flowing between the input and output ports 102*a* and 102*b*.

Figure 3:
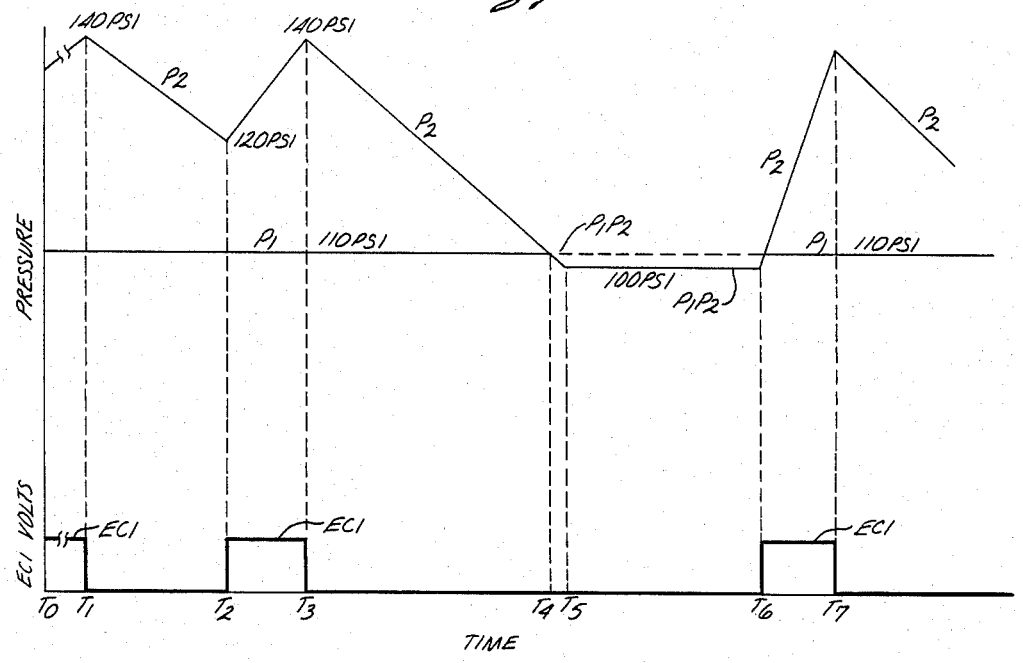
FIG. 3 is a timing diagram illustrating the sequence of operation of a portion of the drilling instrument.

Referring to FIG. 3, the turbine includes turbine blade 102*d* which is rotated by the clean fluid flowing through turbine 102. Turbine shaft 102*c* is connected to and is rotated by the turbine blade 102*d*. Turbine shaft 102*c* in turn is connected to and rotates rotor 100*a* of electrical generator 100, thereby generating electrical energy in transformer 103*b*.

Significantly, the clean fluid is a separate fluid in that it is totally sealed and separated from the mud in collar 4 by passages 201. Since the blades of the turbine are only exposed to the fluid in the sealed passages, the turbine is protected and isolated from the harmful effects of the mud. Although valves 106 and 108 are schematically depicted externally to the collar 4, the pilot valve 106 is preferably mounted at 202 in the housing of upstream reservoir 80 and the control valve 108 is mounted at 204 in actuator housing 46.

SYSTEM OPERATION

Referring to FIG. 1, during a typical well hole drilling operation, mud pump 18 pumps drilling mud from reservoir or mud pit 20 into the drill string 12. The drilling mud passes down through passage 4*a*, collar 4 to and around drill bit 5 for cooling the bit and bailing cuttings uphole through borehole 16 along the annulus around the drill string 12. The drilling mud returned uphole is discharged into mud pit 20.

With drilling mud flowing through collar 4 in a steady state manner and in the absence of an electrical control signal (from the electronic instrument package 104) at the electrical control input 106*h* of pilot valve 106, the valves 106 and 108 are at the states shown in FIG. 2. Accordingly the lower pressure in downstream reservoir 68, hereinafter called "reference" pressure, is coupled to the hydraulic control input port 108*c* by way of conduits 131, 128 and ports 106*c* and 106*a* of fluid pilot control valve 106 and conduit 129. This causes the condition of valve 108 depicted in FIG. 2. Additionally the lower reference pressure in downstream reservoir 68 is coupled to chamber portion 55 of pulser 15 via conduits 131, 128, 130, ports 108*b* and 108*a* of control valve 108, and conduit 114. Chamber portion 54 of pulser 15 is also connected to downstream reservoir 68 by way of conduits 118, 127 and 131 and therefore the chamber portions 54 and 55 are connected together. By virtue of the impact force of the mud flow on the poppet 44 as the mud flows through the collar 4, the poppet 44 will be in its retracted position (i.e., to the right as depicted in FIG. 2). This is permitted by the interconnection of chamber portions 54 and 55.

During this steady state mud flow condition, a pressure drop develops between the region just upstream of the annular ring 36 and the region downstream from ring 36. Typically this pressure drop is approximately 20 to 50 psi. Thus at steady state the fluid in the upstream reservoir 80 is at a pressure between 20 and 50 psi greater than the reference pressure in reservoir 68.

Assume now that electrical control circuits (not shown) in electronic instrument 104 initially generate an electrical control signal on conductor 132 relative to ground (not shown). Upon occurrence of the control signal, pilot valve 106 shifts position to couple the clean fluid in the upstream reservoir 80 through ports 106*d* and 106*a* of valve 106 to the control input 108*c* of control valve 108. The higher upstream reservoir pressure at input 108*c* causes the control valve 108 to change state, thereby coupling the upstream reservoir 80 through conduits 110, 112, ports 108*d* and 108*a* of valve 108 and conduit 114 to chamber portion 55 (i.e., the downstream side of piston 50). The higher pressure acting on piston 50 causes the piston 50 to move left toward the extended position and move the poppet 44 toward the annular ring 36, thus restricting the flow of mud through the ring.

As a result there is an increase in the pressure drop of the mud flowing through the annular ring 36. The upstream pressure of the mud at upstream reservoir 80 thus increases with respect to the reference pressure. As the upstream pressure increases, piston 84 moves to the left in an upstream direction, causing the clean fluid, acting now under greater pressure, to flow from the upstream reservoir portion 86 and into piston chamber portion 55 through conduits 110, 112 and 114 and valve 108. Thus the increasing upstream pressure causes the poppet 44 to still further extend into the annular ring 36. The regenerative effect of coupling the increased upstream pressure to the piston chamber portion 55 provides for rapid extension of the poppet 44 while overcoming any opposing forces arising due to the increased upstream pressure acting upon the exterior end wall of poppet 44. When the poppet 44 engages the ring 36, the mud will flow along the collar 4 through poppet passageways 45.

Typically, as the poppet 44 moves left to the extended condition, the pressure drop between the upstream portion of annular ring 36 and the reference pressure at the downstream reservoir 68, will rise. The foregoing, however, presupposes that the mud flow rate is maintained fairly constant. Typically, in oil well drilling operations, the manner of mud pumping provides for relatively constant mud flow rates. As a result of the constant mud flow rate, the pressure drop just described rises to approximately 150 to 230 psi. The net pressure rise therefore (when considering the 20 to 50 psi steady state value) is thus approximately 130 to 180 psi.

When in the "pulsed" condition just described, the high pressure fluid in the upstream reservoir 80 also serves to charge accumulator 92 through conduit 116 and check valve 142. Specifically, chamber portion 95 of accumulator 92 is coupled to the reference pressure in downstream reservoir 68 by means of conduits 136, 127 and 131. Due to the high pressure from the upstream reservoir, fluid enters chamber portion 97 of the accumulator 92 via conduits 110 and 116, check valve 142 and conduit 134, causing the piston 96 to move against spring 98 in a downstream direction. Thus energy is stored in the spring 98 due to the downstream directed movement of piston 96.

Fluid from the upstream reservoir 80 is also directed by means of conduits 110, 116 and 126 into chamber portion 60 of the pump 47. The resultant force on piston 56 causes the pistons 56 and 58 to move against spring 66 in a downstream direction. As previously noted, the volume of chamber portion 62 is somewhat greater than chamber portion 60 so that piston movement in a downstream direction causes a small pressure drop in chamber 62. As a result the pressure in chamber portion 62 will be somewhat less than the pressure in the downstream reservoir 68. Consequently the fluid required to maintain chamber portion 62 completely filled is delivered from downstream reservoir 68 by way of conduit 131, check valve 120 and conduit 122. The downstream directed motion of piston 56 causes coil spring 66 to be compressed, thereby storing energy in the spring.

While the high pressure exists in the upstream reservoir 80 due to the pressure pulse, clean fluid is also delivered to the turbine input port 102*a* from upstream reservoir 80 through conduits 110, 116, check valve 142, conduit 134 and pressure regulator 138. The fluid passing through the turbine exits from turbine output port 102*b* and into the chamber portion 95 of accumulator 92 through shutoff valve 140, conduit 136 and into the downstream reservoir 68 through conduits 127 and 131. Thus the pressure differential of the clean fluid across turbine 102 in conduits 134 and 136 gives rise to a flow of clean fluid through the turbine, rotating the turbine blades.

Shutoff valve 140 is coupled serially between the fluid output port 102*b* of the turbine 102 and conduits 127 and 136. The shutoff valve will prevent fluid flow through the turbine 102 when the pressure of the fluid in conduit 134 is below a predetermined threshold value relative to that in conduit 136. The shutoff valve 140 is preferably spring loaded and permits flow through the valve as long as a sensed test pressure exceeds the predetermined threshold value. Preferably the test pressure is provided from conduit 134 as depicted by dotted line between valve 140 and conduit 134. Preferably the threshold value is about 100 psi. Pressure regulator valve 138, coupled between conduit 134 and the fluid inlet 102*a* of turbine 102, maintains the pressure at the turbine input 102*a* at a predetermined constant value of preferably about 110 psi, whereas the output 102*b* is essentially at the reference pressure of downstream reservoir 68.

Thus during the period of time that the fluid pressure in the upstream reservoir 80 exceeds 110 psi, fluid from the upstream reservoir 80 will flow by way of check valve 142 and conduit 134 through the turbine 102. The fluid flow in the turbine 102 rotates the turbine blade which in turn is coupled to and rotates the armature of generator 100, thereby generating A.C. electrical energy. The power converter 103 rectifies the A.C. electrical energy to D.C. electrical energy for application to the electronic instrument package 104. The electrical energy provides the power necessary, by way of example, to generate the control signals for pilot valve 106.

Removal of the electrical control signal at input 106*h* of pilot valve 106 by electronic instrument package 104 causes the foregoing sequence to be reversed. More specifically upon removal of the electrical signal at input 106*h* of pilot valve 106, the valve 106 will return to the flow connection as shown in FIG. 2. The reference pressure at the downstream reservoir 68 is thus applied by means of conduits 131, 128, 130, ports 106*d* and 106*a* of pilot valve 106, and conduit 129 to the hydraulic control input 108*c* of valve 108, switching valve 108 back to the position shown in FIG. 2. Consequently, chamber portion 55 is again in fluid communication with downstream reservoir 68 by way of conduit 114, ports 108*a* and 108*b* of valve 108, and conduits 128 and 131, and also chamber portions 54 and 55 are connected together.

Additionally the upstream reservoir 80 is connected to the chamber portion 60 of pump 47 through conduits 110, 116 and 126; to piston chamber 62 through conduits 110 and 116, check valve 124 and conduit 122; and to downstream reservoir 68 through conduits 110 and 116, check valves 124 and 120 and conduit 131. The high pressure existing on the poppet 44 causes the poppet to retract rapidly since the piston chamber portions 54 and 55 are connected together and are therefore at equal pressures. To this end, as the poppet retracts, fluid in chamber portion 55 enters chamber portion 54 by way of conduit 114, ports 108*a* and 108*b* of control valve 108, and conduits 128, 127 and 118.

As the piston 50 and poppet 44 retract, the pressure just upstream of the annular ring 36 drops to the low pressure pre-mud pulse value of 20 to 50 psi and the fluid in the upstream reservoir 80 is replenished by the pump 47. More specifically, the energy stored in coil spring 66 moves the pistons 56 and 58 to the left in an upstream direction. Consequently, clean fluid in chamber portion 60 is moved into the upstream reservoir 80 through conduits 126, 116 and 110, and fluid in chamber portion 62 is moved into the upstream reservoir 80 through conduit 122, check valve 124 and conduits 116 and 110.

Because of the low fluid pressure in the upstream reservoir 80 as compared with accumulator 92, check valve 142 isolates conduit 116 from accumulator 92. Since the check valve 142 isolates the accumulator from the upstream reservoir, the energy stored in coil spring 98 is released, causing an upstream directed movement of piston 96. Consequently the fluid in the upstream portion 97 of accumulator chamber 94 flows through conduit 134 and pressure regulator valve 138 to the turbine inlet 102*a*. The fluid passes through the turbine 102 and through shutoff valve 140 to the downstream reservoir 68 through conduits 127 and 131.

At the commencement of the discharge from chamber portion 97, the fluid pressure in chamber portion 97 is substantially the same as the pressure of the fluid in the upstream reservoir 80 existing just prior to removal of the electrical control signal from pilot valve 106. As coil spring 98 extends, fluid is discharged from upstream chamber portion 97 at a uniformly decreasing pressure. As long as the discharge fluid pressure exceeds 100 psi, the shutoff valve 140 permits fluid flow through turbine 102 and corresponding power generation by the alternator. If the fluid pressure in the upstream chamber 97 drops below 100 psi, the shutoff valve 140 terminates flow through the turbine and correspondingly terminates power generation by the alternator. Preferably, however, the design is such that this condition does not occur during normal operation.

A time history graph of the accumulator fluid pressure and the turbine input fluid pressure versus time is presented in FIG. 3. The pressure P1 depicts the pressure of the regulated clean fluid at port 102*a* of turbine 102, and the pressure P2 depicts the pressure in the upstream chamber portion 97. The waveform ECI depicts the electrical control signal applied to the pilot valve 106. For purposes of discussion, the initial signal ECI terminates at T1 and at such time the pressure P2 is at approximately 140 psi. In the absence of the ECI signal, the accumulator 92 discharges fluid into the turbine 102 at a uniform in time decreasing pressure. Since the pressure at P2 exceeds 110 psi, the pressure regulator valve 138 maintains the turbine inlet pressure at 110 psi.

At time T2, the pressure P2 is at approximately 120 psi and the ECI signal is applied to the pilot valve. The pressure P2 increases rapidly during the existence of the ECI signal. At time T3 the ECI signal is removed. During the period T2 through T3, fluid is supplied to the pressure regulator valve 138 from the upstream reservoir 80. At time T3, the accumulator commences delivering fluid as previously discussed. In the absence of an ECI signal, the accumulator will continue to discharge and the regulator valve will maintain regulation until the fluid in the accumulator is at a pressure of about 110 psi. At time T4 the pressure P2 is depicted as being equal to 110 psi and the regulator valve 138 is now incapable of providing a regulated output.

Thus, below the 110 psi value, the pressures P1 and P2 become equal. When P1=P2=100 psi, the turbine flow terminates since the shutoff valve 140 prevents the discharge of fluid from the turbine. At time T5, therefore, since the check valve 142 and the shutoff valve 140 prevent fluid from the accumulator from discharging, P1 and P2 will be equal and remain at 100 psi.

At time T6 the control signal ECI is applied to the pilot valve 106 and the pressure of the fluid in the upstream reservoir begins to rise. Accordingly the accumulator begins to charge and P1 and P2 begin to rise. Above 100 psi, turbine flow commences, and beyond 110 psi, the pressure regulator valve 138 maintains the input of the turbine 102 at a constant 110 psi.

FIG. 3 illustrates the pressure time history of the accumulator and turbine pressures under a condition where the pressure regulator can no longer provide a pressure regulated output.

Preferably the timing of the ECI signal is such that the value of P2 never goes below 110 psi. Under such conditions the shutoff valve 140 permits fluid to discharge from the turbine, thereby providing continuous power generation by the alternator 100.

It will be understood by those skilled in the art that the electronic instrument 104 may be located either upstream adjacent reservoir 80 or downhole in the flow of mud at a convenient location. Additionally the electronic instrument 104 may be mechanically connected to other portions of the instrument 26 or may be mechanically separated.

It will become evident to those skilled in the art that the electrical energy generating system may be of the type depicted in FIG. 2 wherein the turbine 102, alternator 100 and converter 103 provide the sole source of electrical energy for the electronic instrument 104. The electronic instrument 104 in turn contains the necessary sequence, timing and control to provide electrical signals to terminal **106*h* of pilot valve 106**.

Alternately, the electrical energy generating subsystem may be of the type which includes a battery which is recharged by the electrical energy generated by turbine 102 and alternator 100. Alternately the power necessary to operate the electronic instrument 104 may derive a portion of the electrical power from a battery and a portion from the turbine powered generator.

Figure 5:
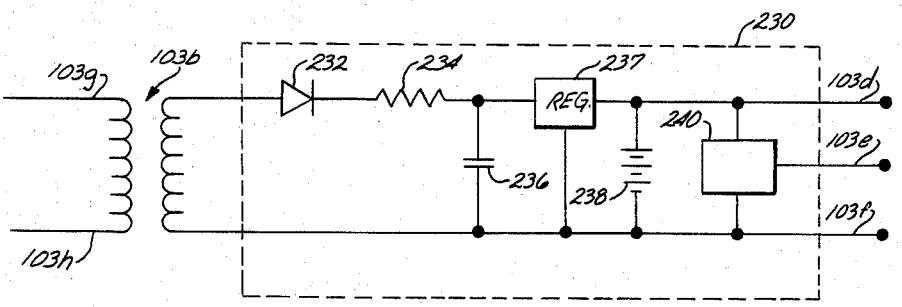
* and FIG. 5 is a schematic diagram of an alternate form of an electrical circuit for use in the system of FIG. 2 wherein a battery is charged by the electrical generating system.

FIG. 5 is a schematic and block diagram depicting the transformer **103*b* with its terminals connected to conductors 103*g* and 103*h*, and its secondary connected across electrical circuit 230. The electrical circuit 230 contains a series circuit including rectifying diode 232, resistor 234 and capacitor 236 connected across the secondary of transformer 103*b*. The positive electrical signals that pass through diode 232 are integrated by the resistor-capacitor circuit elements 234 and 236. The integrated electrical signals formed across the capacitor 236 are applied through a conventional regulator 237 to the terminals of a battery 238. The terminals of battery 238 are connected to output conductors 103*d* and 103*f* referenced in FIG. 2. A voltage divider circuit 240 provides electrical energy on conductor 103*e* which is intermediate the signal on output conductors 103*d* and 103*f***.

While the basic principle of this invention has been herein illustrated along with one embodiment, it will be appreciated by those skilled in the art that variations in the disclosed arrangement both as to its details and as to the organization of such details may be made without departing from the spirit and scope thereof. Accordingly it is intended that the foregoing disclosure and the showings made in the drawings will be considered only as illustrative of the principles of the invention and not construed in a limiting sense.

What is claimed:

1. A drilling instrument having electrical generating means for use in the passage of a conduit through which mud is forced to flow, the instrument comprising:

at least one passage for containing a fluid separate from the mud in the conduit passage;

means for forming a pressure pulse in the mud flowing in the passage of the conduit;

an upstream reservoir for containing the separate fluid and for positioning at an upstream position in the flow of mud from the means for forming a pressure pulse, the upstream reservoir being characterized in that it provides pressure from the adjacent mud to the separate fluid therein;

an accumulator for the separate fluid and comprising a movable piston biased in one direction in the accumulator;

the at least one passage comprising a passage portion coupled for receiving separate fluid from the upstream reservoir and the accumulator;

the separate fluid flowing from the upstream reservoir, responsive to the pressure pulse in the mud, into the accumulator for moving the piston against the bias, and along said passage portion, energy stored from the movement of the piston against the bias subsequently forcing the biased piston to move and force the separate fluid to flow out of the accumulator and along the passage portion;

the movable piston in the accumulator comprising a spring biased piston for storing energy when separate fluid is received therein from the upstream reservoir and for moving the piston to thereby move the fluid through the passage portion;

an electrical generator; and means responsive to the movement of the separate fluid in the at least one passage for providing a mechanical movement to the electrical generator, the electrical generator being responsive to the movement for generating electrical energy.

2. A drilling instrument having electrical generating means for use in the passage of a conduit through which mud is forced to flow, the instrument comprising:

at least one passage for containing a fluid separate from the mud in the conduit passage;

means for forming a pressure pulse in the mud flowing in the passage of the conduit;

an upstream reservoir for containing the separate fluid and for positioning at an upstream position in the flow of mud from the means for forming a pressure pulse, the upstream reservoir being characterized in that it provides pressure from the adjacent mud to the separate fluid therein;

an accumulator for the separate fluid and comprising a movable piston biased in one direction in the accumulator;

the at least one passage comprising a passage portion coupled for receiving separate fluid from the upstream reservoir and the accumulator;

the separate fluid flowing from the upstream reservoir, responsive to the pressure pulse in the mud, into the accumulator for moving the piston against the bias, and along said passage portion, energy stored from the movement of the piston against the bias subsequently forcing the biased piston to move in the direction of the bias and force the separate fluid to flow out of the accumulator and along the passage portion;

the means for forming a pressure pulse comprising an actuation chamber for the separate fluid and wherein the instrument comprises a fluid valve for coupling and uncoupling the separate fluid from the upstream reservoir to the actuation chamber;

the means for forming a pressure pulse comprising means responsive to the pressure of the separate fluid, from the upstream reservoir, in the actuation chamber for forming a pressure pulse in the flowing mud;

an electrical generator; and means responsive to the movement of the separate fluid in the at least one passage for providing a mechanical movement to the electrical generator, the electrical generator being responsive to the movement for generating electrical energy.

3. An instrument according to either of claims 1 or 2 comprising a hydraulic pump for receiving separate fluid from at least the upstream reservoir during a pressure pulse and for delivering separate fluid back to the upstream reservoir following the pressure pulse.

4. An instrument according to claim 3 wherein the pump comprises at least one chamber containing a spring biased piston for storing energy as fluid flows therein from the upstream reservoir, the stored energy moving the piston and hence separate fluid from the at least one chamber back to the upstream reservoir.

* * * * *